United States Patent [19]

Terauds

[11] Patent Number: 4,563,001

[45] Date of Patent: Jan. 7, 1986

[54] PORTABLE EXERCISING DEVICE

[76] Inventor: Juris Terauds, 2450 Lozana Rd., Del Mar, Calif. 92014

[21] Appl. No.: 562,069

[22] Filed: Dec. 16, 1983

[51] Int. Cl.[4] ..... A63B 21/00; A63B 23/04

[52] U.S. Cl. ..... 272/72; 272/130

[58] Field of Search ..... 272/69, 70, 73, DIG. 9, 272/96, 97, 130, 135, 93, 72, 134, 126, 141; 128/25 B

[56] References Cited

U.S. PATENT DOCUMENTS

| | | | |
|---|---|---|---|
| 3,747,924 | 7/1973 | Champoux | 272/DIG. 4 |
| 3,756,595 | 9/1973 | Hague | 272/135 |
| 3,970,302 | 7/1976 | McFee | 272/130 |
| 4,240,627 | 12/1980 | Brentham | 272/130 |
| 4,371,160 | 2/1983 | Shooltz | 272/96 |
| 4,426,077 | 1/1984 | Becker | 272/130 |
| 4,470,071 | 10/1984 | Brown et al. | 272/130 |

FOREIGN PATENT DOCUMENTS

| | | | |
|---|---|---|---|
| 0073744 | 3/1983 | European Pat. Off. | 272/96 |
| 2002808 | 10/1969 | France | 272/73 |

*Primary Examiner*—Richard J. Apley
*Assistant Examiner*—S. R. Crow

[57] ABSTRACT

A portable exercising device having a pair of laterally spaced lever arms whose forward ends are pivotally attached to a base frame assembly. Each lever arm has a resistance cylinder whose bottom end is pivotally attached to the base frame assembly and whose top end is pivotally attached adjacent to the rear end of the lever arms. Each lever arm has a foot pedal plate mounted thereon. An action-reaction structure causes one of the lever arms to pivot upwardly in response to the other lever arm member being pivoted downwardly and also vice versa. A pair of telescoping pole members have their bottom ends attached to the action-reaction structure and they are capable of a forward and rearward pivoting action which is coordinated with the up and down pivotal motion of the lever arm members.

10 Claims, 4 Drawing Figures

PORTABLE EXERCISING DEVICE

BACKGROUND OF THE INVENTION

The invention generally relates to manual exercisers suitable for physical fitness, rehabilitation and athletic training and conditioning for cardiovascular endurance or strength development, and more particularly to an adjustable variable resistance exerciser to be operated by moving two pedals and cam levers against a resistance.

Mechanization of unprecedented proportions has sharply reduced the need for an expenditure of physical energy in daily living and the production of goods and services in contemporary society. The resultant lack of activity in an affluent society has increased obesity problems coupled with rising dangers in cardiovascular health and the ability of many persons to carry out normal daily tasks efficiently and safely. While most inventions aim at labor-saving and the conservation of human energy expenditures, the present invention is designed to provide a work media capable of creating a desired training and rehabilitation effect with convenience, economy and safety.

Fortunately, to remediate many of the physical fitness and rehabilitation problems, various forms of exercisers and regimens have been contrived, designed and developed to improve endurance, strength and cardiovascular function. In many situations existing training machines and methods are adequate, however, there are instances where this is not true. These are problem as illustrated by the following examples; training by jogging can be traumatic for many persons who are elderly or who have cardiovascular problems, jogging can also be inconvenient during foul weather or when on a trip where facilities are not available, exercise treadmills are cumbersome and produce much of the same trauma as jogging without a treadmill, bicycle ergometers are cumbersome and produce trauma in particular at the crotch of elderly persons, a jogging trampoline is ballistic in nature and does not provide an economical training effect, the local health club is often expensive and inconvenient, and so on. The above and other problems encountered during an extensive project on the biomechanical and physiological considerations of elderly participation in physical activity lead to the development of new training methods, which culminated in the present invention of the adjustable variable resistance exerciser.

The basic assumptions and guidelines for the present invention were to develop a machine which would be: (a) for large muscle involvement, such as the legs, arms, and body, (b) variable in resistance and such that the work performed on the invention can be either isokinetic or isotonic in nature, (c) easily adjustable for resistance changes, (d) safe to operate, (e) capable of producing a training effect for strength endurance and cardiovascular condition maintenance or improvement, (f) of a biomechically sound design, compatible with the mechanical movements of the human body, (g) portable for trips, (h) light in weight, and (i) inexpensive to manufacture. With the above guidelines in mind several prototypes of the adjustable variable resistance exerciser were extensively tested using biomechanical and work physiology laboratory procedures and where necessary the invention was modified to its present state.

The present invention, as an adjustable variable resistance exerciser, is new and constitutes an overall improvement on machines designed for use by the legs and arms for strength, endurance and cardiovascular training and conditioning. There is research evidence that the isokinectic nature of the present invention can produce a training effect over a greater range of movement than isometric procedures and the desired training effect can be reached over a shorter period of time than with isotonic procedures alone. Further, by adjusting the resistance on the present invention, the training effect can be localized for strength training, by increasing the resistance, or adjusted for endurance training, by decreasing the resistance. Also, the work can be performed at an aerobic or anaerobic rate. In addition, the isokinetic nature of the invention lends itself to tauma free work, for rehabilitation and the elderly, since even the highest resistance exerciser can be worked at mild work levels when the cadence is kept low.

SUMMARY OF THE INVENTION

This invention relates to new and beneficial improvements in manual exercisers for the legs and arms, suitable for physical fitness, rehabilitation, and atheletic training and conditioning for cardiovascular or strength develment, and has for its primary object to provide, in a manner as hereinafter set forth, an adjustable variable resistance exerciser of this character comprising novel structure for training against an adjustable resistance such as a hydraulic or pneumatic device. Another very important object of the present invention is to provide an adjustable resistance exerciser such that it is durable, light weight and readily made portable for trips when folded for that purpose. Other objects of the invention are to provide a silent exerciser of the aforementioned character which will be comparatively simple in construction, strong, durable, compact, of light weight, easy to adjust and which may be manufactured at low cost. These together with other objects and advantages which will become subsequently apparent reside in the details of construction and operation as more fully hereinafter described and claimed.

DESCRIPTION OF THE PREFERRED EMBODIMENT

Figure 1:
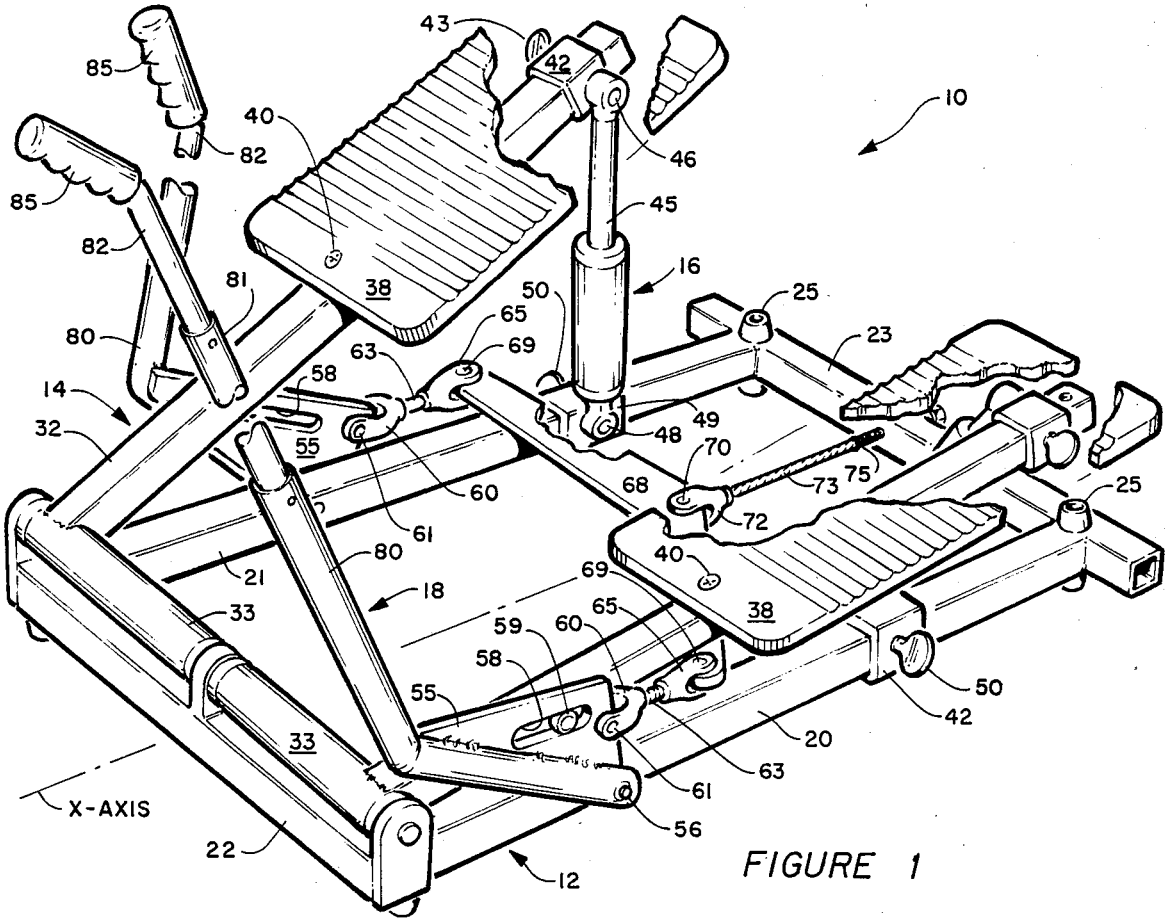
FIG. 1 is a perspective view of the novel portable exercising device with portions broken away for clarity.
Figure 2:
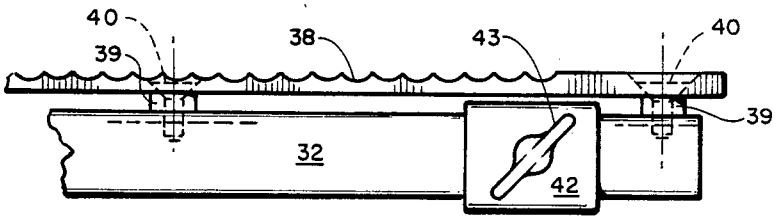
FIG. 2 is a partial side elevation view illustrating how the top end of the resistance cylinder is made adjustable along the length of the lever arm.
Figure 3:
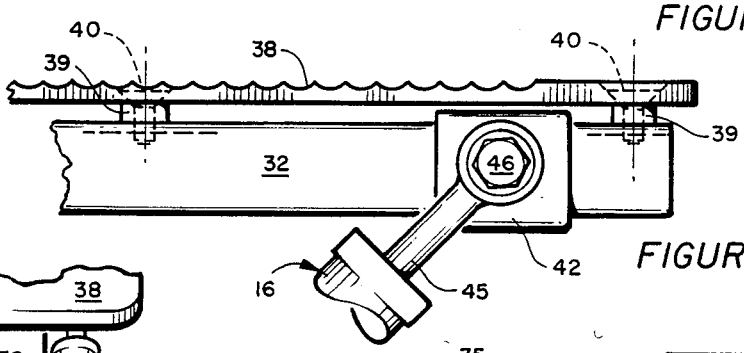
FIG. 3 is a partial side elevation view showing how the top end of the resistance cylinder is attached to the clamp bracket that is slideable on the lever arm.
Figure 4:
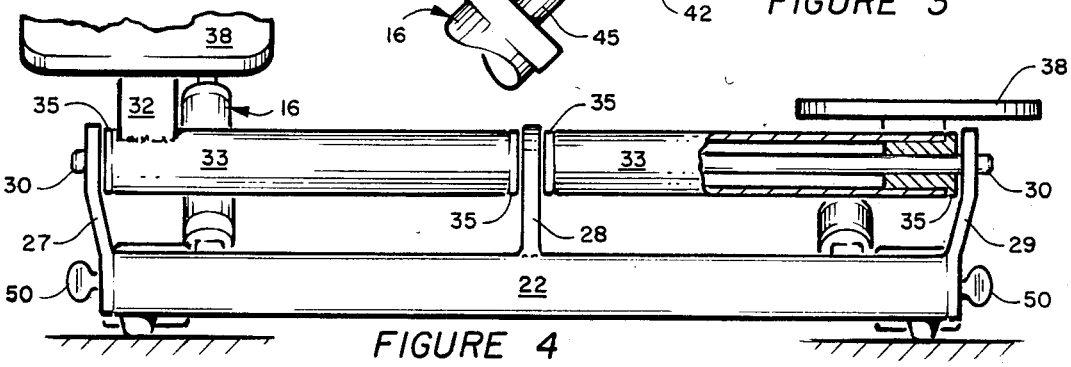
FIG. 4 is a partial front elevation view of the novel portable exercising device with portions broken away for clarity.

Applicant's novel portable exercising device will now be described by referring to FIGS. 1–4. The exercising device is generally designated numeral 10. It has a base frame assembly 12, a pair of laterally spaced lever arm members 14, a pair of resistance cylinders 16, and a pair of telescoping pole members 18.

The base frame assembly 12 is formed from a pair of laterally spaced longitudinally extending members 20 and 21 and front cross member 22 and rear cross member 23 that are respectively connected to the opposite ends of said longitudinal 20 and 21. Cushions 25 are mounted on the top surface of rear cross member 23 to soften the force of the lever arms 14 as they strike the base frame assembly. The front end of the base frame assembly has a plurality of upwardly extending brackets 27,28 and 29. A shaft 30 is journaled in aligned apertures in these three brackets.

The L-shaped lever arms 14 have a long leg portion 32 and short leg portion 33. Short leg portion 33 is in the form of a tubular sleeve and it has a Teflon bearing 35 inserted in each of its ends through which passes shaft 30 and which allows the lever arms 14 to pivot upwardly with respect to base frame assembly 12. A foot pedal plate 38 is mounted on spacers 39 and attached to the top surface of lever arms 14 by screws 40. A clamp bracket 42 is adjustable along the length of lever arm 14 and may be locked in any desired position by set screw 43. Clamp bracket 42 is moveable along the space created between the bottom of foot pedal plate 38 and the top surface of lever arm 14 (See FIGS. 2 and 3).

The resistance cylinders 16 may be of a hydraulic or pneumatic variety. There piston rod 45 is journaled on a pin 46 extending laterally from bracket 42. The bottom end of resistance cylinders 16 is journaled on a pin 48 extending laterally from bracket 49 that is mounted on one of the longitudinal members of base frame assembly 12. Bracket 49 is adjustable lengthwise along the longitudinal members 20 and 21 and may be locked in position by set screw 50. In order to adjust the resistance produced by resistance cylinders 16, clamp brackets 42 and 49 may be adjusted individually or in combination to vary the amount of resistance produced against the lever arm member 14 as they are forced downwardly. Resistance is increased as clamp bracket 42 is moved back and clamp bracket 49 is moved rearwardly. Likewise resistance is decreased as clamp bracket 42 is moved forward and clamp bracket 49 is moved forwardly.

A pair of pivot plate members 55 have their lower ends pivotally journaled about pins 56 that extend laterally from the longitudinal members 20 and 21. These pivot plate members 55 have a slot in which a cam follower 59 is captured. The cam follower 59 extends laterally from the L-shaped lever arms 14. Attached to the rear of the pivot plate members 55 are yoke members 60 that pivot about pins 61 passing through the pivot plate member 55. A wire cable 63 has its one end attached to yoke member 60 and its other end attached to yoke member 65. Yoke members 65 are pivotally attached to the opposite ends of bell crank 68 by pins 69. A central pin 70 passes through the pivot point of bell crank 68 and has a yoke 72 pivotally attached thereto. Wire cable 73 has its one end attached to yoke member 72 and it has a threaded sleeve 75 formed on its other end that passes through an aperture in rear cross member 23 and has a tightening nut threaded thereon which can be threaded inwardly or outwardly in order to vary the vertical axis of central pin 70 forwardly and rearwardly. A tightening of the nut on threaded sleeve 75 will cause the L-shaped lever arms 14 to be raised pivotally upwardly. A loosening of the nut would have the reverse effect. Telescoping members 18 are formed from a plurality of telescoping sections 80,81 and 82. The lower end of section 80 is attached to the pivot plate member 55. The top end of telescoping section 82 has a hand grip 85.

In the operation of the portable exercising device, the person using it will press downwardly with his foot on the right foot pedal plate 38 until the L-shaped lever arm 14 comes to rest against the cushion 25. At the same time the person using the device would push forward on the right hand grip 85 and pull rearwardly on the left hand grip 85. Next the force is shifted from the right foot to the left foot and it would force the left foot pedal plate 38 downwardly until it comes to rest on cushion 25. While this is occuring the person using the device would also push forward on the left hand grip 85 and pull rearwardly on the right hand grip.

What is claimed is:

1. A portable exercising device comprising:

a base frame assembly having a longitudinal axis extending from its forward end to its rearward end;

a pair of laterally spaced lever arm members each of which is substantially oriented in parallel alignment with the longitudinal axis of said base frame assembly;

means for pivotally securing the forward ends of said lever arm members to said base frame assembly adjacent its forward ends;

a foot pedal plate mounted on each of said lever arms adjacent their rearward ends;

a pair of resistance cylinders each of which has a top end and a bottom end;

first attachment means for pivotally attaching the top end of said respective resistance cylliner to said respective lever arm members;

second attachment means for pivotally attaching the bottom ends of said resistance cylinders to said base frame assembly;

action-reaction means for causing one of said lever arm members to pivot upwardly in response to said other lever arm member being pivoted downwardly and also vice versa; and wherein said action-reaction means comprises a pair of laterally spaced pivot plate members, said pivot plate members being vertically oriented and each of which has its lower end pivotally attached to said base frame assembly.

2. A portable exercising device as recited in claim 1 wherein said lever arm members are L-shaped in configuration.

3. A portable exercising device as recited in claim 1 wherein said resistance cylinders are hydraulic cylinders.

4. A portable exercising device as recited in claim 1 wherein said first attachment means has structure that allows it to be attached to said lever arm members at multiple positions along the length of said lever arm members.

5. A portable exercising device as recited in claim 1 wherein said second attachment means has structure that allows it to be attached to said base frame assembly at multiple positions along the length of said base frame assembly.

6. A portable exercising device as recited in claim 1 wherein said action-reaction means further comprises said pivot plate members each having an elongated slot of a predetermined configuration and said respective lever arm members each have a laterally extending cam follower that is captured in said elongated slots.

7. A portable exercising device as recited in claim 6 wherein said action-reaction means further comprises a laterally oriented bell crank whose central point is pivotable about a central pin secured to said base frame assembly and whose opposite ends have structure pivotally securing them to said respective pivot plate members.

8. A portable exercising device as recited in claim 7 wherein said action-reaction means further comprises structure for moving the vertical axis of said central pin axially along the longitudinal axis of said base frame assembly.

9. A portable exercising device as recited in claim 1 further comprising a pair of pole members having their bottom ends attached to said respective pivot plate members.

10. A portable exercising device as recited in claim 9 wherein said pole members are each formed of a plurality of telescoping sections.

* * * * *